US006719161B1

(12) United States Patent
Craig

(10) Patent No.: US 6,719,161 B1
(45) Date of Patent: Apr. 13, 2004

(54) STORAGE CONTAINER FOR LIQUIDS

(76) Inventor: Troy Craig, 4600 Dimond Way, Wasilla, AK (US) 99654

( * ) Notice: Subject to any disclaimer, the term of this patent is extended or adjusted under 35 U.S.C. 154(b) by 0 days.

(21) Appl. No.: 10/452,187

(22) Filed: Jun. 2, 2003

(51) Int. Cl.[7] ..... B65D 25/20
(52) U.S. Cl. ..... 220/23.4; 222/143
(58) Field of Search ..... 220/23.4, 564, 220/23.8; 222/143, 465.1

(56) References Cited

U.S. PATENT DOCUMENTS

| | | | | | |
|---|---|---|---|---|---|
| 3,815,281 | A | * | 6/1974 | Kander | 446/77 |
| 4,003,491 | A | * | 1/1977 | Wells et al. | 220/23.4 |
| 4,228,897 | A | * | 10/1980 | Underwood | 206/504 |
| 4,889,254 | A | * | 12/1989 | Vola | 220/23.4 |
| 5,413,236 | A | * | 5/1995 | Kenevan | 220/4.28 |
| 6,006,935 | A | * | 12/1999 | Driver | 220/23.4 |
| 6,352,167 | B1 | * | 3/2002 | Yu | 220/522 |

OTHER PUBLICATIONS

JAZ Products Catalog p. 304 Date Unknown "Moose Find Containers" —Has a Diveratil Type Connector.

* cited by examiner

*Primary Examiner*—Joseph Man-Fu Moy
(74) *Attorney, Agent, or Firm*—Michael J. Tavella

(57) ABSTRACT

A storage container for liquids. The container has a see-through sight marked to clearly see amount of product in the container. It uses placards to identify the product stored in the container. The container has a wide and stable bottom so it does not tip over easily. The can has small holes in each corner to secure a bungee cord. The containers can be stacked for easy storage. The containers have dovetails formed about the base so that they can lock together on the sides making securing then less time consuming and easier. The spout is stored in the handle to prevent contamination and to keep a user's hands away from the contents of the container. Thus, the container is designed to get the contents into a fuel tank while keeping the product off the ground, the user, and machinery, in a safe, secure, easy to use portable container.

13 Claims, 10 Drawing Sheets

STORAGE CONTAINER FOR LIQUIDS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to storage containers for liquids and particularly to storage containers for liquids having built-in tie-down points and dovetailing base sections.

2. Description of the Prior Art

Storage containers for liquids, such a gas cans (note that the term "gas can" as used herein applies to any container used to store fluid, such as kerosene, water, mixed gas and oil, and other liquids) have been used ever since the automobile has existed. These cans carried a supply of gas for a vehicle when the number of gas stations was rare. Originally, gas cans were made of metal and were square and tall. Over time, the cans were made of plastic and adopted a smaller size and shape. Some gas cans are generally, square, while others are rounded. Typically, the cans have a fill/pour port and a vent. The inlet port has a nozzle that acts like a funnel. The nozzle is typically stored inside the can when it is not needed. The fill [pour port has a screw on cover that seals it to prevent leaks. To pour gas, the user removed the screw on cover, removes the nozzle, reverses it, places on the fill/pour port, replaces the screw-on cap, opens the vent and pours the gas. To store the can, the user reverses these steps.

Although these cans work well, they have a number of problems. First: by storing the nozzle in the can, the user must be exposed to the gas in the can when the user removes the nozzle. Most often, this is nothing more than an inconvenience. However, in extremely cold temperatures, it can be dangerous. Because gas does not freeze at 30 degrees F., liquid gas can exist at very low temperatures. Removing a gas-covered nozzle at very low temperatures can cause frostbite.

Second, some can designs (e.g., tall and skinny) are unstable and can easily be tipped. The rounded, more stable designs are inconvenient because they cannot readily be stacked. Moreover, all cans stored in a bed of truck or on an all terrain vehicle must be tied down to secure them. Typically, the only tie down point available is the handle on the can. This can work, but is limiting and difficult at best.

Some patented designs for gas cans are found in the following U. S. Patents: U.S. Pat. No. 5,108,016 teaches a cylindrical can that has a fill port on top of the can and a thin hose to dispense the gas. This design is difficult to use because the hose is flexible and must be held or otherwise supported in place. To dispense gas from the container, it must be turned over to dispense the gas through the hose. There is no handle on the container. Thus dispensing the gas takes two hands. Holding the hose requires a third hand. Finally, the hose has a small diameter. This makes dispensing the gas slow and time consuming. Three design Patents to McFarlane, (D259,767, D267,630 and D296,986) teach funnel shaped containers that have elongated spouts. The device shown in Patent No. D296,986 appears to be inherently unstable and prone to falling from an upright position. These containers have a nice appearance, but do not appear to be practical. Finally, Design Patent Nos. D291,282, D278,031, D279,549, D433,635, and D434,328 teach a variety of generally cubical containers for storing gas. These all suffer from a number of problems. As noted above, they are not readily stackable, they are difficult to secure in a truck bed or trailer, they cannot be readily tied together, and they have poor locations for their spouts. The spout location of these devices is such that the container must be tipped over to empty the container. While this is not a problem in some circumstances, it can be a problem where space is limited and there is no room to tip the container enough to completely drain it.

BRIEF DESCRIPTION OF THE INVENTION

The instant invention is an improved gas can. The can has a number of features that make it easier and safer to carry and use. Some of these features are: the gas can has gaskets made of material that is environmentally friendly and does not leak at any temperature. The plastic used to make can has different colors for the different product stored (one for gas, one for water, etc. The plastic material also does not break down, become weak over time, or fade due to ultraviolet radiation. The backside of the can has a see-through clear area sight marked with gallons/ounces and liters to clearly see amount of product in the can. These scales also make premixing of gas or precise measuring easy. The can comes with pre-made changeable placards that can be selected to identify the product stored in the can, as well as blanks placards to write your own type of product stored in can. The use of placards also provides additional safety and environmental protection. Without the placards, a user with several cans containing different fluids and mixes may have to smell the contents or may even spill a little of the contents to verify exactly what is in a given container. This is not only dangerous for health; it is also an environmental hazard. Placards eliminate the need to "check" what is in the can. The placards also have an area to write additional information such as the user's name and address. In this way, the contents of any given can are easily known.

The can is wide and stable on the bottom so it does not tip over easily. The can it has half rounded areas on the front and back of the can top where a round bungee cord can be held in place for securing the can; a small hole is provided in each corner (4) of the can to secure the hook end of a bungee cord for securing the can to all terrain vehicles, snowmobile racks etc. The shape of the can allows cans to be stacked on top of each other (when empty) for compact personal storage or easier store display. Cans have dovetails formed about the base so that they can lock together on the sides making securing then less time consuming and easier. Note that herein, the term "dovetail" includes any interlocking type joint, such as half-rounds, box joints, finger joints, and the angled dovetail joints. Any other similar type of interlocking joint may also be used. The can has rubber comfort grip handles on the top, side and bottom, allowing operator to stand in a more upright position for comfort and less stress on the back, (the bottom handle is also part of the locking system for stacking). The can is designed to empty completely when held at a 90-degree angle. The pour spout is flexible so that it holds any given shape; in this way, a user can bend the spout to desired angle allowing no spill, easy hand pouring. The spout is clear and may be marked with ounces and cubic centimeters (cc's) for use in measuring two stroke oils and additives. The spout is also designed to have an optional water sediment filter screen built in. The pour spout is stored in handle of gas can keeping spout clean and free from dirt and contaminants. It also stores the spout so that the gas or other product does not get on the user's hands (or anything else) if used properly. The gas can vent has a plastic or rubber cap that will not break under normal use. This cap has a quick turn opening valve that requires only a ½ turn to fully open the vent. The cap is not removed from the can. In this way, the can cannot become lost.

In summary, all of the features of this invention are designed to get the stored product in a designated fuel tank and to keep the product off the ground, the user, and machinery, in a safe, secure, easy to use portable container.

DETAILED DESCRIPTION OF THE INVENTION

Figure 1:
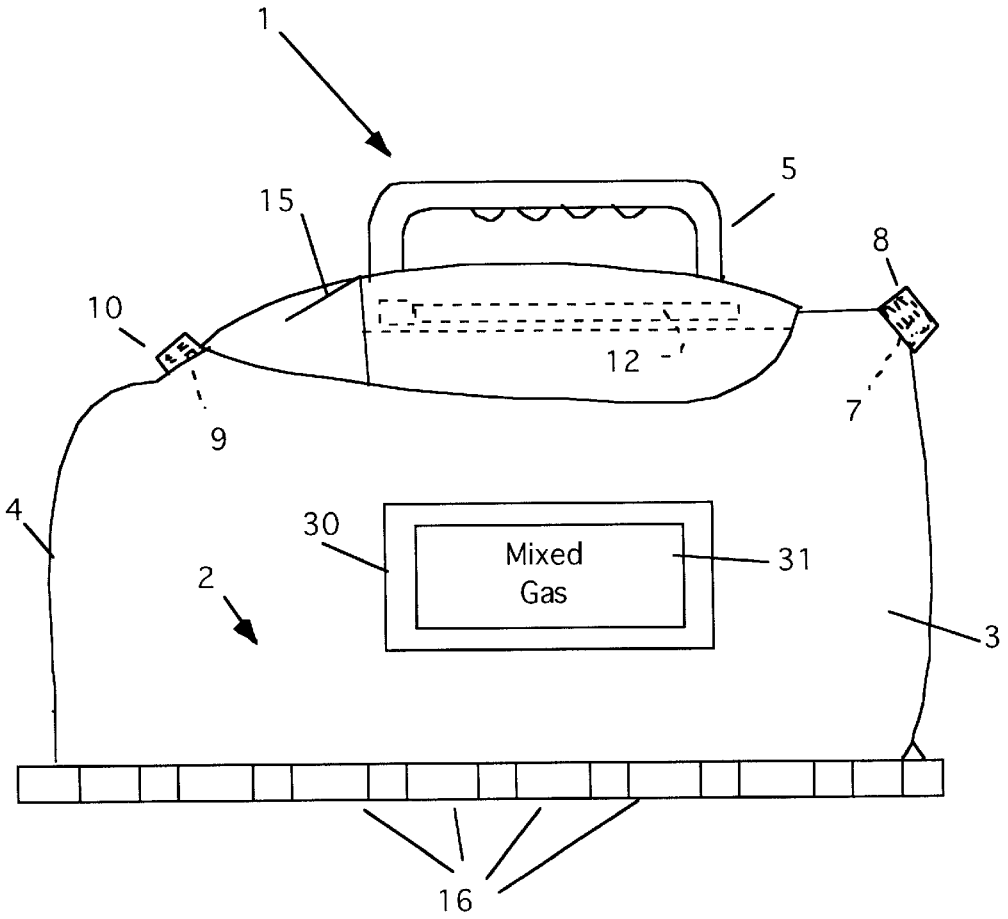
FIG. 1 is a side view of the invention.

Referring now to FIG. 1, a side view of the invention 1 is shown. The invention consists of a smooth sided container 2 that has a front 3 and a back 4. A handle 5 is formed at the top of the container as shown. Note that there is a gap 6 between the bottom of the handle 5 and the container 2. This gap allows a user to grip the handle 5. Note that in the preferred embodiment, the handle 5 has formed finger grip areas for additional comfort and gripping strength.

A filling/dispensing nozzle 7 is formed on the front. A cap 8 clover the nozzle and prevents leaks when the container is not in use. A vent 9 is positioned at the back of the container 2. It is normally covered by a cap 10. Note that the cap 10 is secured to the container to prevent the cap from being misplaced over time. Details of this cap are shown in FIG. 6

A spout 12 is shown in place in the handle 5 for storage. In the preferred embodiment, the spout 12 is flexible so that it can be bent to a given position for pouring. Of course, the spout can also be rigid, if desired. An opening 14 is formed in the handle 5 to hold the spout (see FIG. 3). Storing the spout in the handle keeps the spout handy and clean. Moreover, by storing the spout in the handle, it is not exposed to the liquid (such as gas) in the container. This means that a user no longer has to be exposed to gas when removing the spout and installing it for use. To provide additional protection for the spout 12, a door 15 is attached to the back of the handle storage area (see FIGS. 1 and 3). The door 15 is designed to snap closed and covers the spout storage area completely.

At the bottom of the container 2, are a set of dovetail pins 16 (dovetails) that are formed about the base. Note, as discussed above, the term "dovetails" as used herein is not limited to the traditional angled dovetail joints and includes any interlocking type joint, such as half-rounds, box joints, finger joints, the angled dovetail joints and any other similar type of interlocking joint These dovetails are used to connect containers together, as discussed below.

Finally, on the side of the container 2 is a pocket 30 to hold a small placard 31. The placards 31 indicate the contents of the container. Preprinted placards can be supplied that have "gasoline", "motor oil", "kerosene", "water", "gas/oil mix" or any other common fluid that is typically stored in such cans. The placards also have space for the user's name and address. The placards can also be supplied blank, so that the user can put whatever label the user wants on the can. These placards enable a user to quickly and safely identify the contents of any given can. Many times, people have two or more cans that store different liquids. Putting the wrong liquid into a machine can cause catastrophic failure. Moreover, determining which fluid is in the container can cause heath and environmental problems caused by sniffing the product in the container or spilling a little to see what is stored. The placards eliminate these possibilities.

Figure 2:
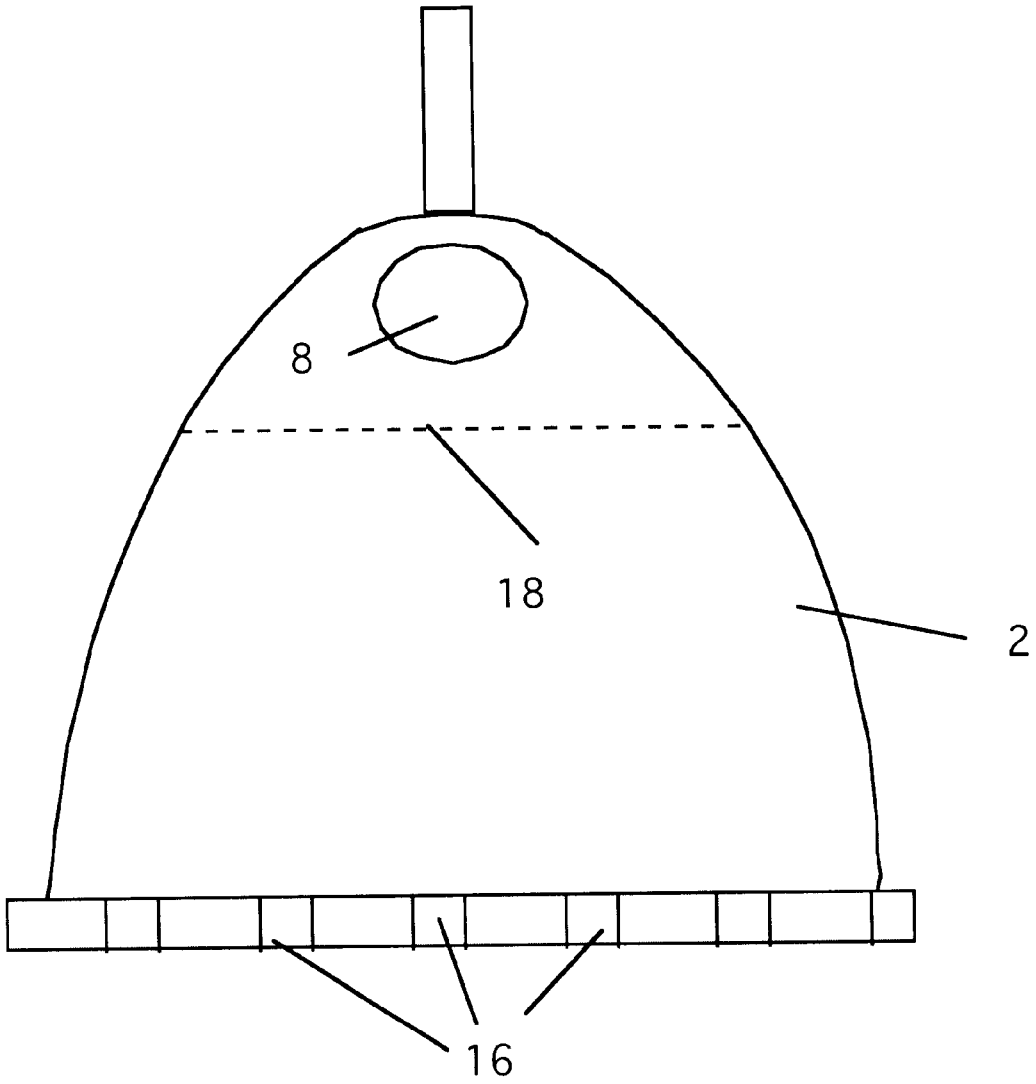
FIG. 2 is a front view of the invention.

FIG. 2 shows the front 3 of the can 1. The front has the filling/dispensing nozzle cover 8. In addition, the front has a fill line 18 marked on the container body 2 to indicate the level of the nominal size of the container (e.g., 1 gallon, 5 gallons, etc.) Note also, at the bottom of the container are the dovetails 16. As noted above, these dovetails wrap around the entire base.

Figure 3:
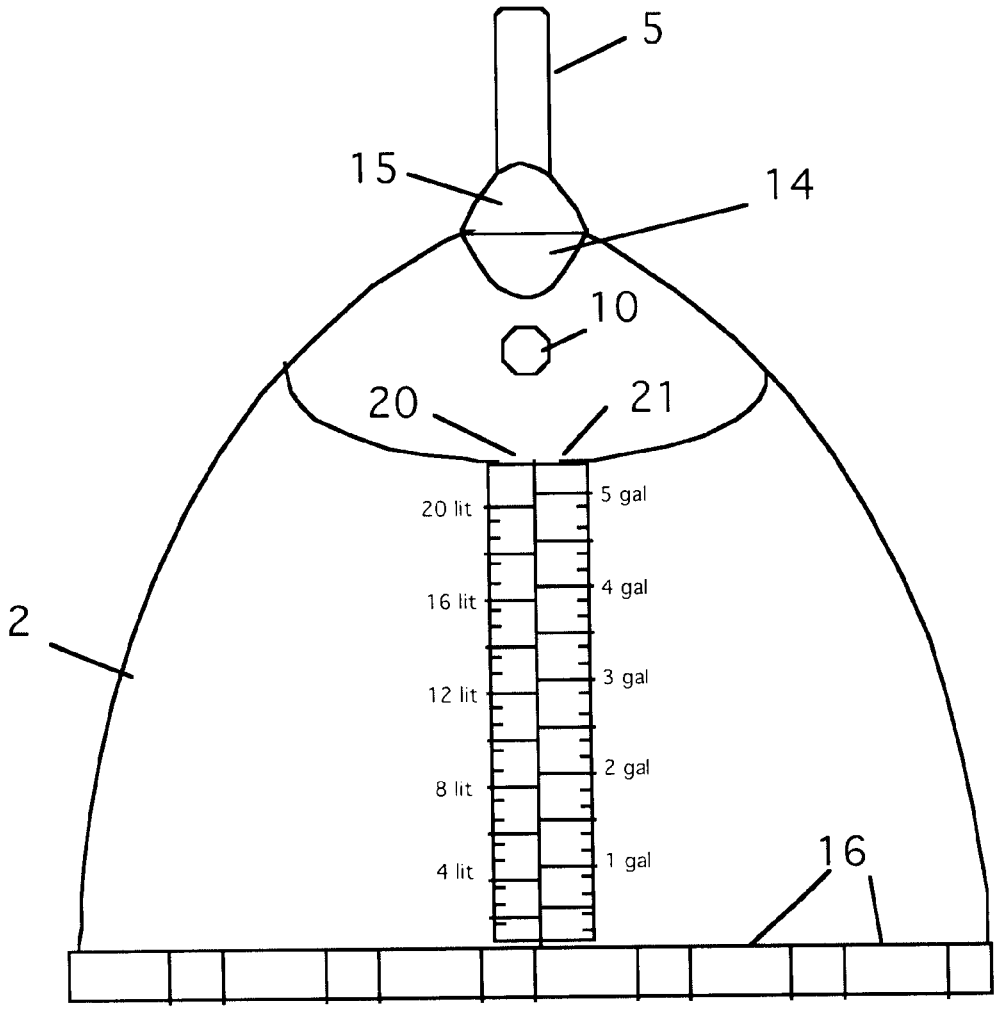
FIG. 3 is a back view of the invention.

FIG. 3 shows the back 4 of the can. Here, the opening 15 in the handle for the spout is shown. The back also has a clear site 20 that shows the amount of liquid in the container. A scale 21 is painted, or otherwise formed on the clear site to measure liters, or ounces, or any other convenient scale of measure. Legends 22 and 23 are also imprinted on the container for convenience.

Figure 4:
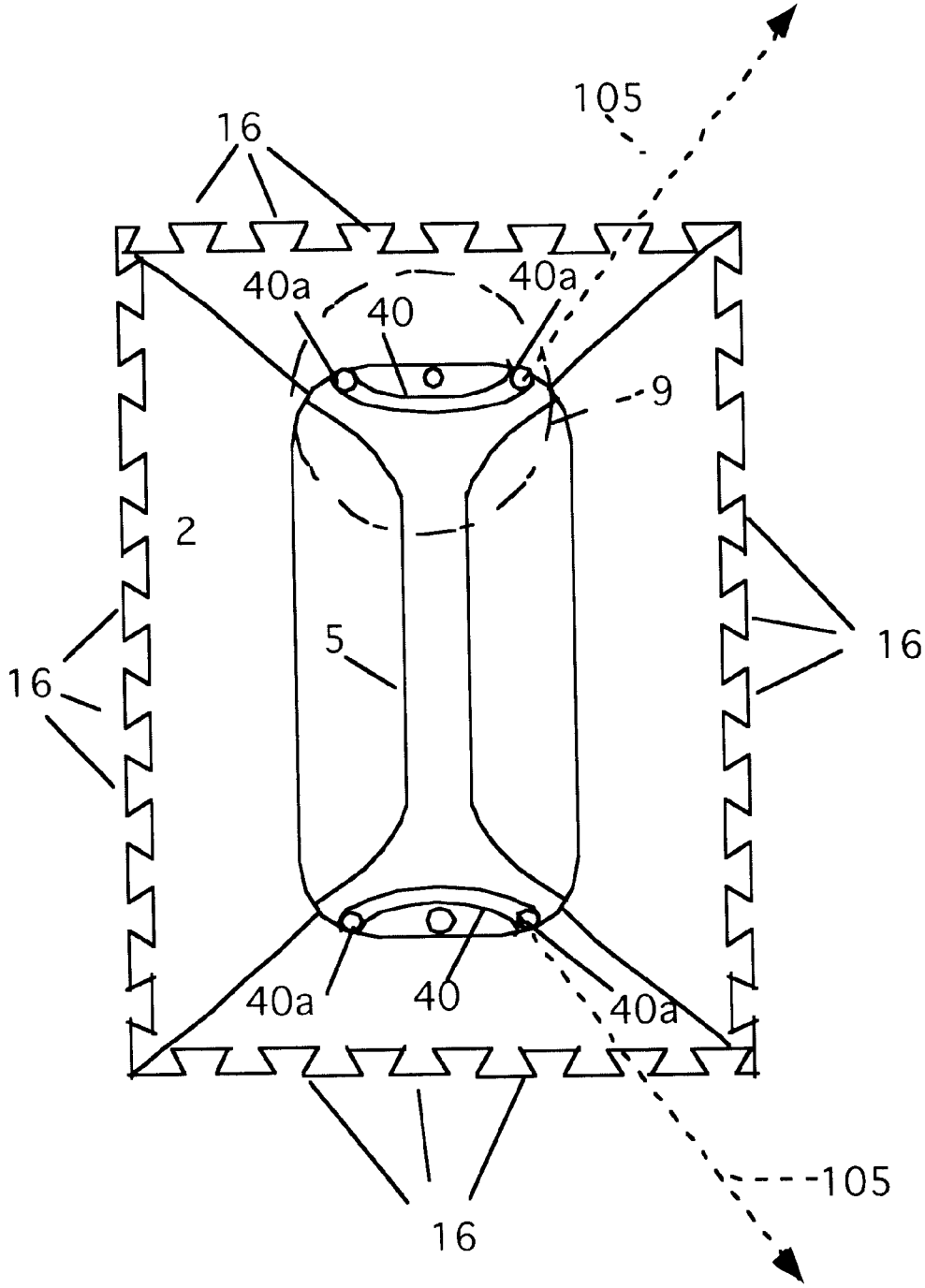
FIG. 4 is a top view of the invention showing optional bungee cord tie-down lines.

FIG. 4 shows the top of the container. Here, the handle 5 is shown without the spout installed. Note that there are two curved tie down supports 40 on the top of the container. These two curved tie down supports 40 have end points 40*a* that are holes formed in the tie down supports. The holes 40*a* accept the hooks of bungee cords, or a length of rope. These points allow bungee cords 105 or ropes to be secured to the can to secure it in place in a truck bed, for example. FIG. 4 also shows the entire dovetail structure 16 that runs about the base of the container 2. The use of the curved tie down supports is discussed in detail below.

Figure 5:
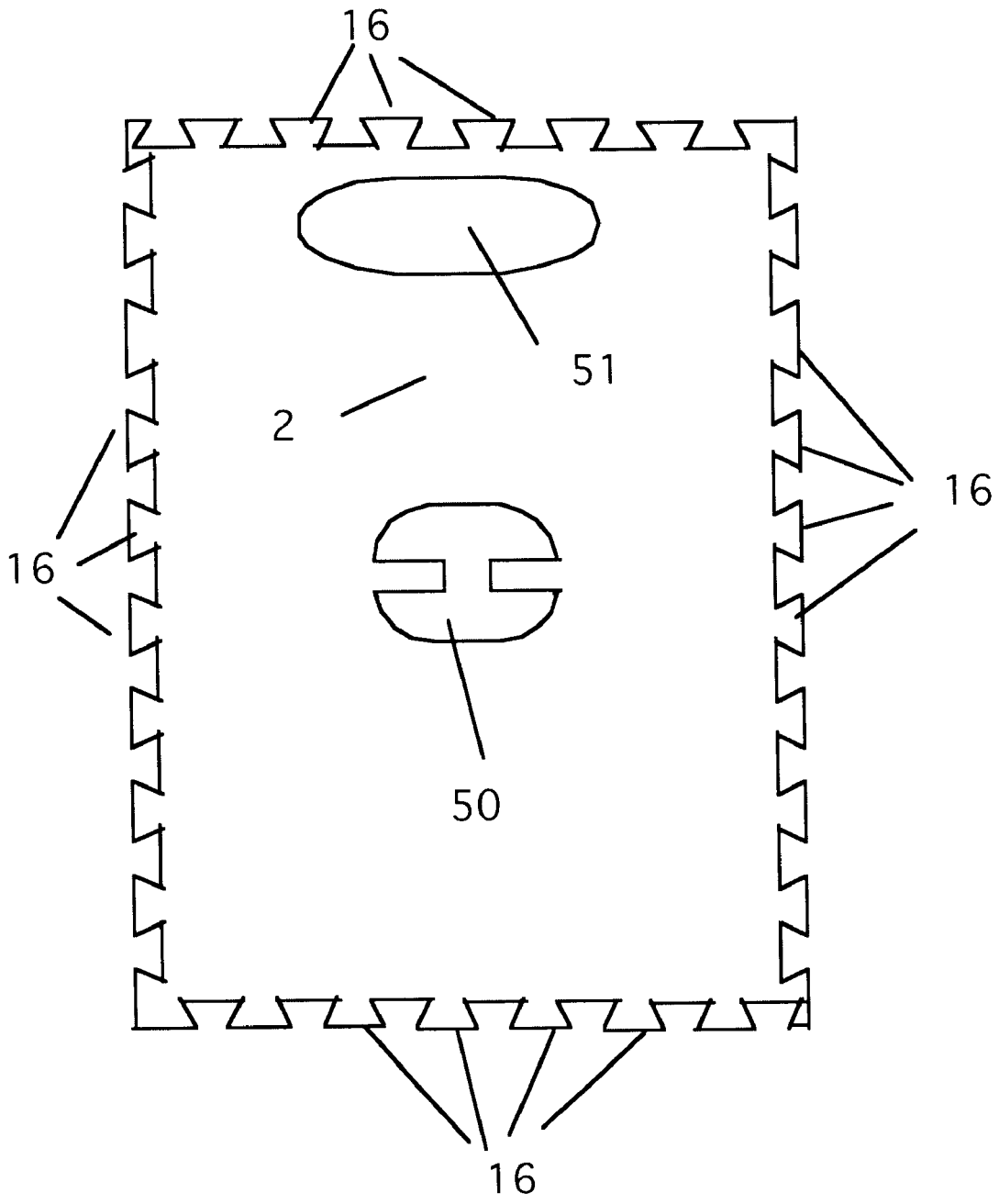
FIG. 5 is a bottom view of the invention.

FIG. 5 shows the bottom of the can. Here, a handle 50 is formed into the base. This handle allows a user to grip the bottom of the container when dispensing fluid. This makes dispensing fluid much more comfortable and safer. In addition, the handle 50 is designed to fit around the handle 5 of another can. In this way, empty cans can be clipped together in stacks for easy storage or for a compact store display. This figure also shows an optional handgrip 51 that is used in the preferred embodiment to allow a different grip position to be used.

Figure 6A:
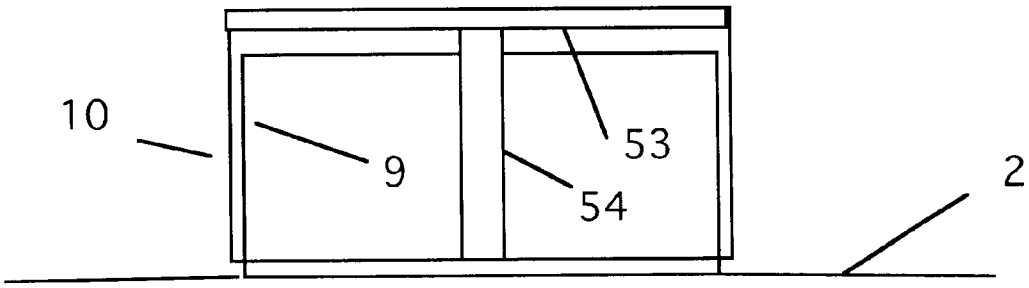
FIG. 6*a* is a detail of the vent cap construction showing the vet cap closed.
Figure 6B:
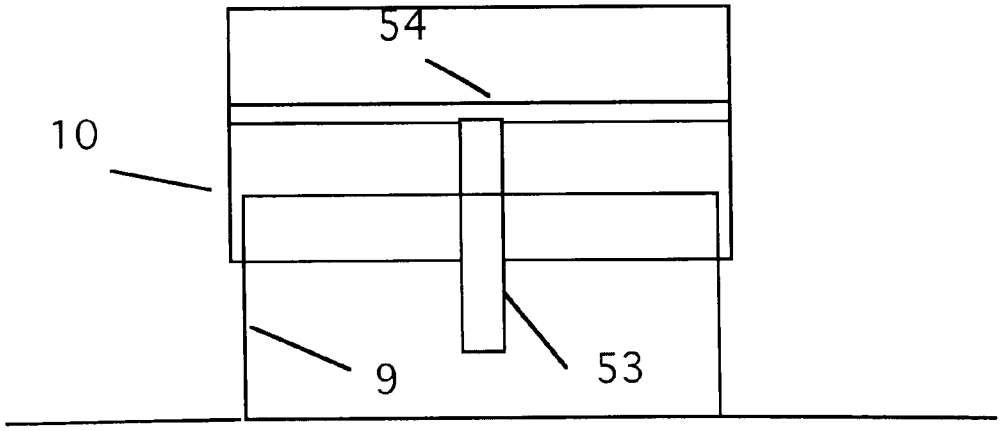
FIG. 6*b* is a detail of the vent cap construction showing the vet cap open.

FIGS. 6*a* and 6*b* show details of the vent cap construction. This is a type of quick close cover design. FIG. 6*a* shows the vent cover closed. Here, the vent cover 10 is shown on top of the vent 9. Note that the threads are not shown for clarity, although both the cap and the vent have threads. The vent seal 53 and the vent plug 54 are shown in the closed position. FIG. 6*b* shows the vent fully opened. Here, the vent cap 10 is raised by turning the cap approximately ½ turn. This causes the seal 53 and plug 54 to rise up and open the vent. In this way, the vent can be easily and quickly opened and closed without having to remove the cap 10, which can become lost.

Figure 7:
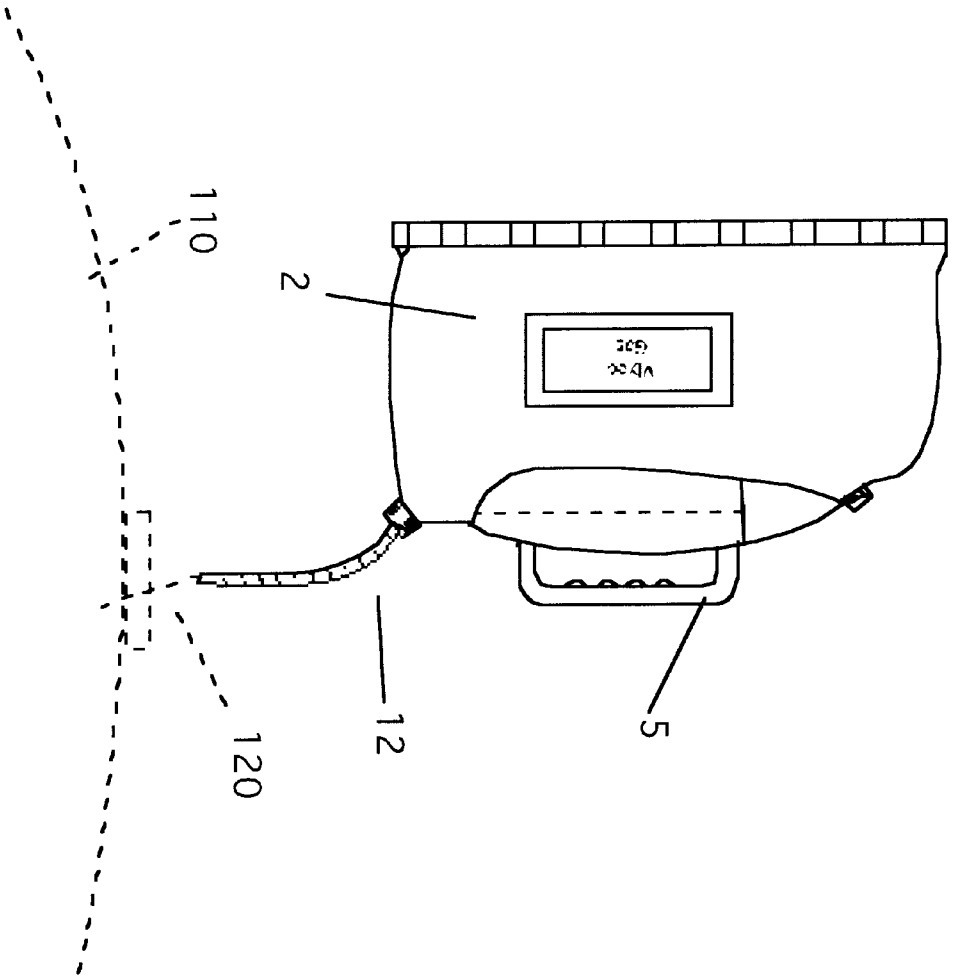
FIG. 7 is a detail view showing the spout in place and liquid being dispensed.

FIG. 7 is a detail view showing the spout 12 in place on the container 2 and liquid 120 being dispensed into another container 110. In this view, the can 1 is rotated 90 degrees to dispense the liquid. The placement of the filling/ dispensing nozzle on the container allows a user to completely empty the can when the can is held in this position. There is no need to rotate the can past 90 degrees, as many cans available today. This makes dispensing easier, especially in tight spaces.

Figure 8:
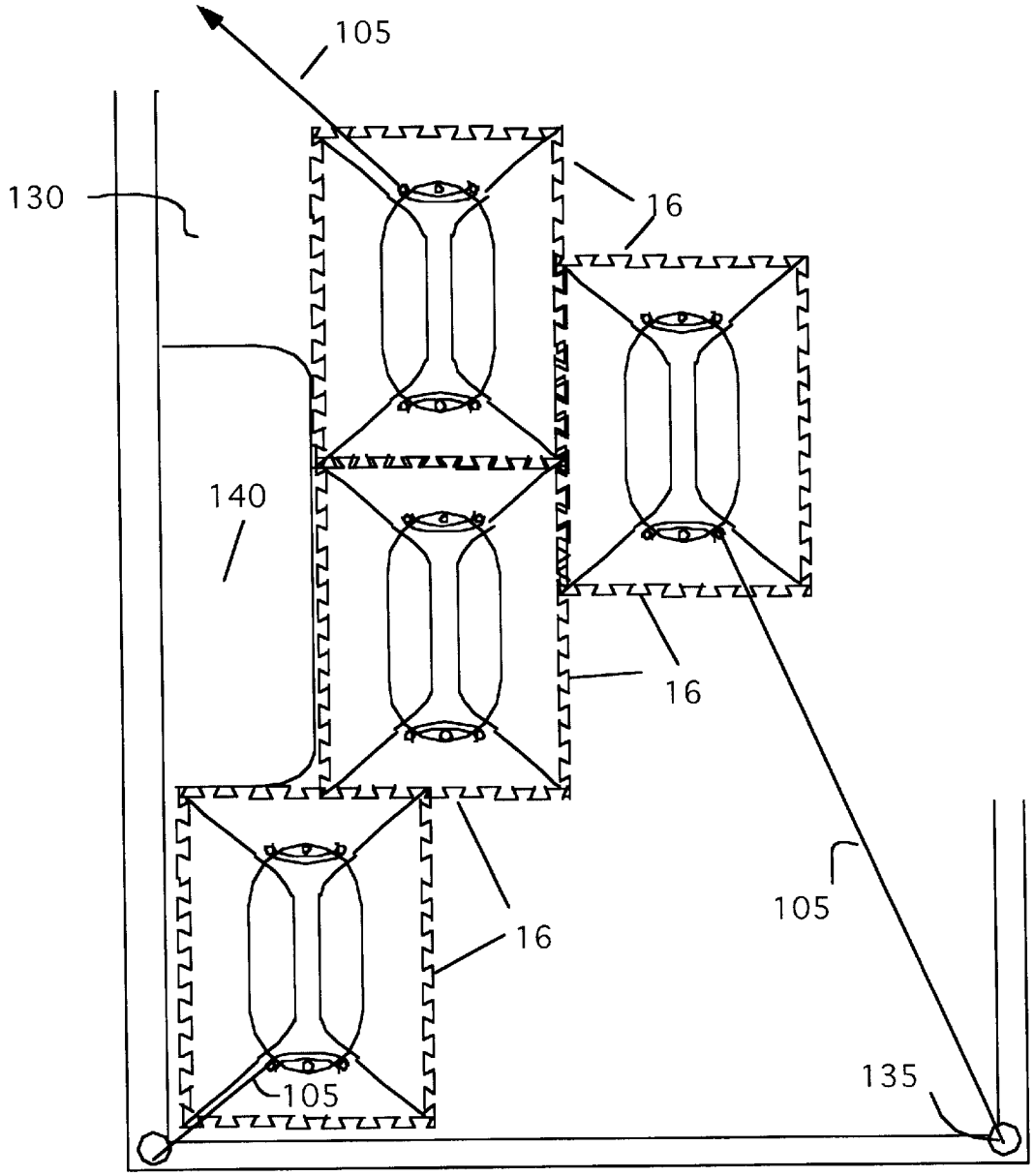
FIG. 8 is a detail of a pick-up truck bed showing a number of containers being connected together for storage.

FIG. 8 is a detail of a pick-up truck bed 130 showing a number of containers 1 being connected together for storage. As mentioned above, each can has a number of dovetails 16 formed on their bases. These dovetails are designed to fit together as shown. By connecting two or more cans, stability of all the cans is increased. Moreover, the dovetails allow corners or portions of the cans to be connected. This allows cans to be placed around a wheel well 140 in the truck bed, for example. Thus connected, many cans be easily secured. As shown in FIG. 8, bungee cords 105 can be connected to tie points 135 on the truck bed. Because of the interlocking capability of the containers, the number of bungee cords needed to secure the containers in minimized.

Figure 9:
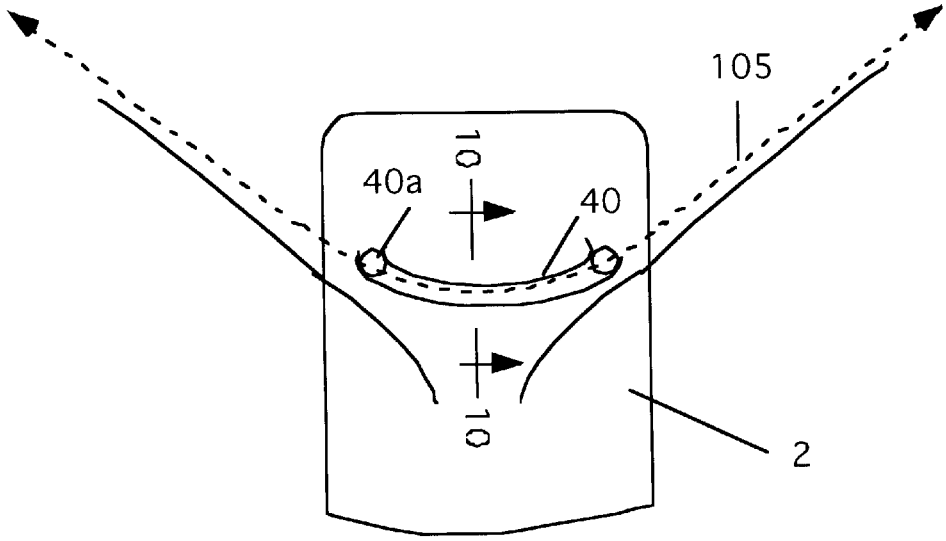
FIG. 9 is a detail view of one type of bungee cord holder.
Figure 10:
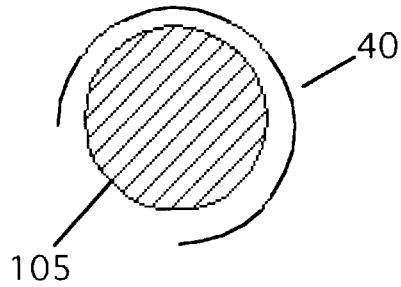
FIG. 10 is a cross-sectional view of the bungee cord holder of FIG. 9, taken along the liens 10—10 of FIG. 9.

FIGS. 9 and 10 show a detail of the curved tie down supports 40. FIG. 9 is an enlargement of an area of the can as shown in FIG. 4. This detail shows the curved tie down supports 40. As discussed above, these supports have points 40*a* on their corners to hook a bungee cord. However, it is also possible to secure a bungee under the edge of this curved piece. FIG. 10 is a cross section showing the curved piece 40 and a bungee cord 105. To use the curved support, the center portion of a bungee cord is slipped under the lip so that it fits within the curved area (see FIG. 10). The ends of the bungee cord then extend out in both directions to enable the can to be secured to vehicles, or trailers.

Figure 11:
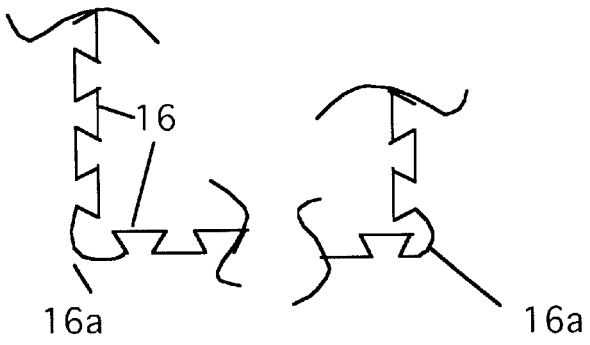
FIG. 11 is a detail of the gas can corners showing rounded edges on the preferred embodiment.
Figure 12:
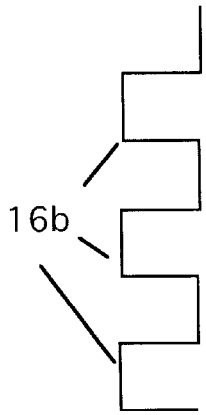
FIG. 12 is a detail view of a box joint type construction of the interlocking joints.
Figure 13:
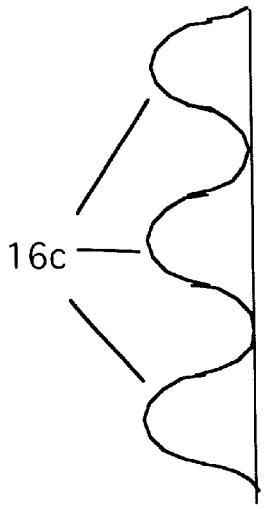
FIG. 13 is a detail view of a half-round joint type construction of the interlocking joints.

As mentioned above, the device has a plurality of dovetail type joints formed about the perimeter. FIG. 11 shows that in the preferred embodiment, these dovetails have curved edges 16*a* to make them safer. FIGS. 12 and 13 show two alternative type joints that may be used. FIG. 12 shows a box joint 16*b* and FIG. 13 shows a half-round type joint 16*c*. Either of these joints may be used in place of the standard dovetail type joint. Moreover, any other type of interlocking joint can be used as well. The intent is to have the ability to lock several cans together for ease in transporting the cans. The type of joint is not critical as long as the cans can be joined in a variety of configurations.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A container for storing liquids comprising:

a) a container body, having a top, a bottom having a perimeter, two sides a front and a back;

b) a handle, attached to the top of said container body;

c) a means for filling said container body with a fluid; and d) a plurality of dovetail connectors, formed about the perimeter of said bottom of said container body.

2. The container of claim 1 wherein the means for filling said container body with a fluid comprises a nozzle, attached to say container body such that liquids can pass through said nozzle into said container and out of said container.

3. The container of claim 2 wherein the means for filling said container body with a fluid further includes a spout, removably attached to said nozzle.

4. The container of claim 2 wherein the handle has an opening formed therein to receive the spout when said spout is removed from said nozzle.

5. The container of claim 4 wherein the handle has a door, hingably attached to cover said opening to receive said spout.

6. The container of claim 1 further comprising at least one tie-down point, formed on the top of said container body.

7. The container of claim 6 wherein said at least one tie down point comprises:

a) a curved member having a hollow center and an open lip portion; and b) wherein said curved member has at least one hold formed therein.

8. The container of claim 1 further comprising:

a) a pocket, attached to one of said two sides of said container body; and b) a placard, removably installed in said pocket, wherein said placard is imprinted with a description of a liquid being stored within said container.

9. The container of claim 1 further comprising a clear strip, formed into the back of said container body, whereby said clear strip acts to display a quantity of liquid being stored within said container.

10. The container of claim 9 wherein said clear strip further comprises a plurality of indicator marks to indicate a measure of the quantity of liquid being stored within said container.

11. The container of claim 1 further comprising a recessed handle, formed in the bottom of said container body.

12. The container of claim 11 wherein the recessed handle is shaped to receive and engage a handle from a second container such that two empty containers may be stacked and locked together for storage or transport.

13. A system for storing and transporting a variety of liquids comprising:

a) a plurality of containers, each of said plurality of containers including:

i) a container body, having a top, a bottom having a perimeter, two sides a front and a back, ii) a handle, attached to the top of said container body, iii)) a means for filling said container body with a fluid, iv) a plurality of dovetail connectors, formed about the perimeter of said bottom of said container body, v) at least one tie-down point, formed on the top of said container body.

vi) a pocket, attached to one of said two sides of said container body, and vii) a placard, removably installed in said pocket, wherein said placard is imprinted with a description of a liquid being stored within said container;

b) whereby said plurality of containers being positioned on a conveyance such that the plurality of dovetail connectors on one container body are engaged with the plurality of dovetail connectors of an adjacent container body; and c) a plurality of means for tying-down said plurality of containers, said plurality of means for tying-down each having two ends, and further whereby one of two ends is secured to said at least one tie-down point, formed on the top of one of said plurality of container bodies, and the second of two ends is secured to said conveyance.

* * * * *